US006955205B2

(12) United States Patent
Lewis

(10) Patent No.: US 6,955,205 B2
(45) Date of Patent: Oct. 18, 2005

(54) PANEL SYSTEM AND HINGE DEVICE THEREFOR

(75) Inventor: Warren Paul Lewis, St. Johns (NZ)

(73) Assignee: Aluminum Systems NZ Limited, Auckland (NZ)

( * ) Notice: Subject to any disclaimer, the term of this patent is extended or adjusted under 35 U.S.C. 154(b) by 0 days.

(21) Appl. No.: 10/294,071

(22) Filed: Nov. 14, 2002

(65) Prior Publication Data

US 2003/0089464 A1 May 15, 2003

(30) Foreign Application Priority Data

Nov. 15, 2001 (NZ) ..... 515518
Sep. 11, 2002 (NZ) ..... 521280

(51) Int. Cl.[7] ..... E05D 15/26
(52) U.S. Cl. ..... 160/206; 160/229.1; 16/229
(58) Field of Search ..... 160/206, 199, 160/229.1; 16/366, 354, 356, 229, 230

(56) References Cited

U.S. PATENT DOCUMENTS 1,659,928 A * 2/1928 Townsend ..... 16/250
3,277,951 A * 10/1966 Levicke ..... 160/185
3,720,255 A * 3/1973 Ueda ..... 160/199
5,682,643 A * 11/1997 Duffy ..... 16/265
6,220,332 B1 * 4/2001 Lai ..... 160/199
6,256,839 B1 * 7/2001 Wu ..... 16/366
2001/0011583 A1 * 8/2001 Spork ..... 160/199

FOREIGN PATENT DOCUMENTS

| | | |
|---|---|---|
| EP | 556 679 | 8/1993 |
| GB | 2 277 550 | 11/1994 |
| NZ | 226 341 | 12/1989 |
| NZ | 506 434 | 7/2002 |

OTHER PUBLICATIONS

Copy of New Zealand Examination Report.

* cited by examiner

*Primary Examiner*—Blair M. Johnson
(74) *Attorney, Agent, or Firm*—Butzel Long

(57) ABSTRACT

A panel system comprises at least one bi-fold panel assembly (2, 3) of two panels hinged together along one edge (18) of each so as to be foldable thereabout, with at least one edge (20, 22, 24, 26) of the bi-fold panel assembly (2, 3) supported by a hinge device (30, 32, 34, 36) comprising two parallel pivot supports spaced apart in a plane orthogonal to pivot axes thereof, and a connecting link for in-situ connection therebetween. Hence the bi-fold panel assembly (2, 3) can be optionally connected in-situ by the connecting link to thereby obtain optional configurations of the panel system.

10 Claims, 14 Drawing Sheets

PANEL SYSTEM AND HINGE DEVICE THEREFOR

BACKGROUND OF THE INVENTION

1. Field of the Invention

The present invention relates to panel systems for walls of buildings and to bi-fold panel systems for openings such as for a door, a window or closet, or for a room partition, and to hinge devices for such systems. However, it is to be understood that the invention is not to be limited as such. Moreover, because the invention may have many other applications, the prior art and possible applications of the invention discussed below are given by way of example only.

2. Description of the Related Art

Conventionally panel systems such as aluminium framed window and door sections for walls and partitions of buildings are generally designed differently to suit their different functions. For example, non folding panels such as fixed aluminium framed window sections, have a simple edge mounting system for mounting in position, opening panels such as for an opening window or door have a hinge system along one side and an opening/closing edge along the other side, and bi-fold panel systems which fold relative to each other have a hinge between the panels to make up a panel assembly. Furthermore, with bi-fold panel systems, usually one edge of the bi-fold panel assembly is adapted for pivotal connection to a frame of an opening, and the other free edge of the bi-fold panel assembly is adapted for abutment with either another frame of the opening or another edge of an adjacent bi-fold panel assembly.

Moreover, to support and guide the free edge of the bi-fold panel assembly there is generally provided a device for locating with a track, incorporating for example a slide or roller which slides or rolls along a fixed guide rail or track provided along the top and/or bottom of the opening.

With such conventional panel systems, the configuration of the panel assembly is designed before installation to suit requirements. As such the opposite edges of the individual panels have different fittings and design to suit their respective purposes. For example with a bi-fold panel system the free edge will generally have a device for locating with a rail or track at the top or bottom, while the opening frame connection edge will not have the rail/track location device since this is not necessary, location being provided by the fixed opening frame connection. Moreover, the configuration for the connecting hinges of the panels are different depending on their application. That is, a hinge configuration for a door frame hinged panel is different from a hinge configuration for connecting two folding panels together. In the case of a hinge for connecting two panels together, this generally comprises a hinge with a single pivot axis of the hinge being located between the hinged edges of the hinged panels. Hence the distances between edges of panels, of for example abutted panels, is different to that for panels such as hinged panels.

Therefore, a problem with such a system is that panels must be made of different sizes with different edge attachments to suit the application. Moreover, the configuration of the panels must be decided on before manufacture or at least before installation and connection of the fittings. Hence a range of different panels must be stocked. Furthermore, when several panels with different functions are fitted to the wall opening, the difference in design and size can detract from the overall appearance.

Moreover, in the case of bi-fold panels, once the panels are installed it is not possible to easily change the configuration. That is to say, for example a configuration with two bi-fold panel assemblies pivotally fixed at opposite edges to opposite side frames of an opening and with the free edges adapted for abutting together, cannot be converted in-situ, for example into a bi-fold panel assembly which folds completely to either side of the opening.

This is disadvantageous in that the bi-fold panel configuration must be decided at least before installation, thus limiting versatility, and design options, and increasing requirements for parts and stock holding, with accompanying costs. Moreover, it is not possible to optionally change configurations in-situ to suit different requirements.

SUMMARY OF THE INVENTION

It is an object of the present invention to address the above problems with conventional panel systems and bi-fold panel assemblies, or to at least provide the public with a useful choice.

Moreover, it is an object of the invention to provide a panel design for a panel system where the panels have different functions, but can all be the same size or of a similar appearance. Furthermore, it is an object of the invention to provide a panel design and connecting hinge design for bi-fold panel assemblies, which can be varied in-situ to suit different configurations of bi-fold panel assemblies.

According to a first aspect of the present invention there is provided a panel system comprising; at least on panel, and a hinge device for supporting one edge of the panel to allow pivotal movement thereabout, wherein the hinge device comprises two parallel pivot supports spaced apart in a plane orthogonal to pivot axes thereof, and a connecting link for connecting therebetween.

By having a panel system wherein the hinge device comprises two parallel pivot supports spaced apart in a plane orthogonal to pivot axes thereof, and a connecting link for connecting therebetween, similar design panels can be connected together to give different configurations, with the opposite edges of the individual panels having similar fittings and design to suit their respective purposes. Hence the same design panel can be used for different functions, depending on whether or not a hinge device or support device is fitted, and the type of hinge device or support device.

For example with no hinge device fitted, the edge of the panel can function as; a standard panel edge such as the edge of a door, the edge of two folding panels, a fixed edge or a door with a conventional hinge. When the hinge device of the invention is fitted, the edge of the panel can function as: the hinged edge of a door hinged to a fixed panel with a similar panel edge by means of the connecting link, or the adjacent hinged edge of a bi-fold panel assembly with hinge devices of the adjacent panels linked together by the connecting link. Moreover the hinge device can also function as a support hinge for connecting to a rail slider.

According to yet another aspect of the present invention there is provided a panel system substantially as described above, wherein the at least one panel comprises a bi-fold panel assembly of two panels hinged together along one edge of each so as to be foldable thereabout. With such an arrangement the panel system of the invention can constitute a bi-fold panel system.

According to yet another aspect of the present invention there is provided a panel system substantially as described above, comprising two or more panels with adjacent edges of at least two panels hinged together with the hinge device so as to be pivotal about their respective edges.

The connecting link may comprise any suitable means whereby the two pivot supports can be connected and allow pivotal movement about at least one of the pivot supports. For example this may comprise a one piece member which is fitted to the hinge device at the time of assembly and fitting of the panels. Moreover this may be adapted so as to be connectable in-situ to the pivot supports. For example this may comprise two members connectable in-situ to the pivot supports.

In the case where the connecting link comprises two members connectable in-situ to the pivot supports, panel assemblies comprising one or more bi-fold panel assemblies can be connected together in-situ, to enable different configurations to be optionally selected after installation. This improves the versatility of the bi-fold panel assembly, enabling a reduction in the number of different parts required, and stock holding, and moreover enables the configuration to be changed in-situ to suit different requirements.

According to an other aspect of the present invention there is provided a panel system comprising a bi-fold panel assembly, wherein at least one edge of the bi-fold panel assembly is adapted for pivotal in-situ connection to an opening frame.

By having at least one edge of the bi-fold panel assembly adapted for in-situ pivotal connection to an opening frame, the bi-fold panel assembly can be optionally connected in-situ to an opening frame. Hence the bi-fold panel assembly can be folded to the opening frame side, or can be disconnected therefrom and slid to another position, as required or desired.

There may be provided a device for locating either one edge or both opposite edges of the bi-fold panel assembly, either so as to be slidable when opening and closing, or so as to be locatable when in the open or closed condition. Such a location device may simply comprise a track at the top or bottom of the opening, along which the edge of the bi-fold panel assembly can slide, or a step for preventing swinging of the bi-fold panel assembly. Moreover, this may comprise a guide member secured to the bi-fold panel assembly which slides in a groove on the top or bottom of the opening in which the bi-fold panel assembly is installed.

According to another aspect of the present invention, there is provided a panel system comprising a bi-fold panel assembly substantially as described above, further comprising a location device for slidably locating both opposite edges of the bi-fold panel assembly.

By providing a location device for slidably locating both opposite edges of the bi-fold panel assembly (rather than only one edge as with some conventional bi-fold panel assemblies), the bi-fold panel assembly can be optionally connected to another bi-fold panel assembly or to either edge of an opening, with the unconnected edge slidably located to ensure location of the edge when opening and closing.

According to another aspect of the present invention there is provided a panel system comprising a bi-fold panel assembly substantially as described above, wherein a pivot support of the hinge device also serves as a member for the location device.

With such a construction, the number of components can be kept to a minimum and the design simplified.

According to yet another aspect of the present invention there is provided a panel system comprising two or more bi-fold panel assemblies substantially as described above, which can be optionally connected in-situ to each other to give different folding configurations.

With such a panel system the bi-fold panel assemblies can be optionally connected in-situ. Hence the above mentioned drawbacks with conventional bi-fold panel systems can be overcome.

According to yet another aspect of the present invention there is provided a hinge device adapted for connecting to a panel of a panel system substantially as described above, the hinge device comprising two parallel pivot pins with at least one of the pivot pins fitted with a mounting device for mounting attachment to an edge of a panel of the panel system, and a connecting link for connecting therebetween so as to hold the pivot pins spaced apart in a plane orthogonal to pivot axes thereof.

According to another aspect of the present invention there is provided a method of enabling optional in-situ configuration within an opening, of a panel system comprising at least one bi-fold panel assembly of two panels hinged together along one edge of each so as to be foldable thereabout, the method comprising the steps of: providing a hinge device for supporting one edge of the bi-fold panel assembly to allow pivotal movement thereabout, the hinge device comprising two parallel pivot supports spaced apart in a plane orthogonal to pivot axes thereof, and a connecting link for in-situ connection therebetween; connecting one of the pivot supports to a side member of the opening, or to the edge of another panel in the opening, and connecting the other of the pivot supports to the one edge of the bi-fold panel assembly; and optionally connecting the pivot supports with the connecting link to obtain an optional configuration of the panel system.

By using such a method, bi-fold panel assemblies can be connected together or optional edges can be connected to the opening frame, in-situ, to enable different configurations after installation, thus providing a more versatile bi-fold panel system, and enabling the configuration to be changed in-situ to suit different requirements.

The present invention may also broadly be said to consist in the parts, elements and features referred to or indicated in the specification of the application, individually or collectively, and any or all combinations of any two or more of the parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

Further aspects of the present invention will become apparent from the ensuing description which is given by way of example only and with reference to the accompanying drawings in which;

FIG. 1 illustrates a junction 100, (A) illustrating a swinging and optional movable connection at an orthogonal partition section with an in-situ detachable connecting link according to the present invention, and (B) illustrating a standard swinging hinge connection at a fixed orthogonal partition section.

FIG. 2 illustrates a junction 200, being a simple folding connection with a pull handle.

FIG. 3 illustrates a junction 300, for abutting ends panels moving on a track.

FIG. 4 illustrates a junction 400, being a door latch connection with an opening door on the right.

FIG. 5 illustrates a junction 500, being an end panel connection of a folding or sliding panel supported on a track.

FIG. 6 illustrates a junction 600, being a door latch connection with an opening door on the left.

FIG. 7 illustrates a junction 700, being an end panel connection of a folding or sliding panel supported on a track and having a door latch for an opening door on the right.

FIG. 8 illustrates a junction 800, being a bi-fold panel connection with an in-situ disconnectable link according the present invention.

DETAILED DESCRIPTION OF THE INVENTION

Embodiments of the present invention will now be described with reference to the figures.

FIG. 1 through FIG. 8 illustrate general aspects of the panel system and hinge device according to the present invention. Components having the same function are denoted by the same reference symbols. In the figures, the panel generally denoted by arrow 101 is a standard panel which is the same for all applications, and is shown here comprising an aluminum extrusion frame 101*a* in which is fitted a glass panel 101*b*.

Figure 1:
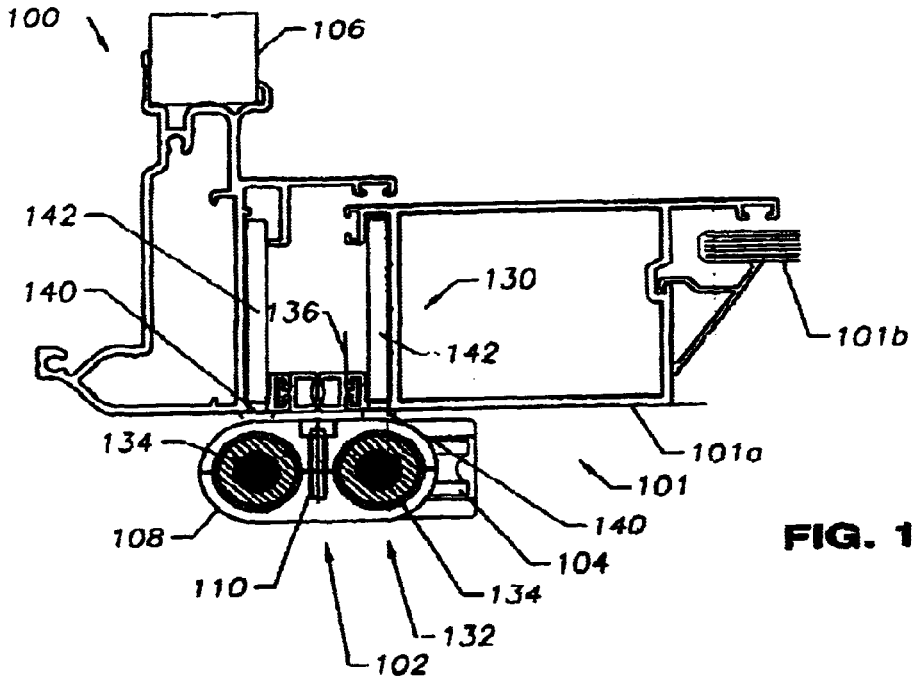
FIG. 1 through FIG. 8 are section views illustrating possible junction configurations which can be provided on a standard design panel to which the present invention is applicable.
Figure 1:
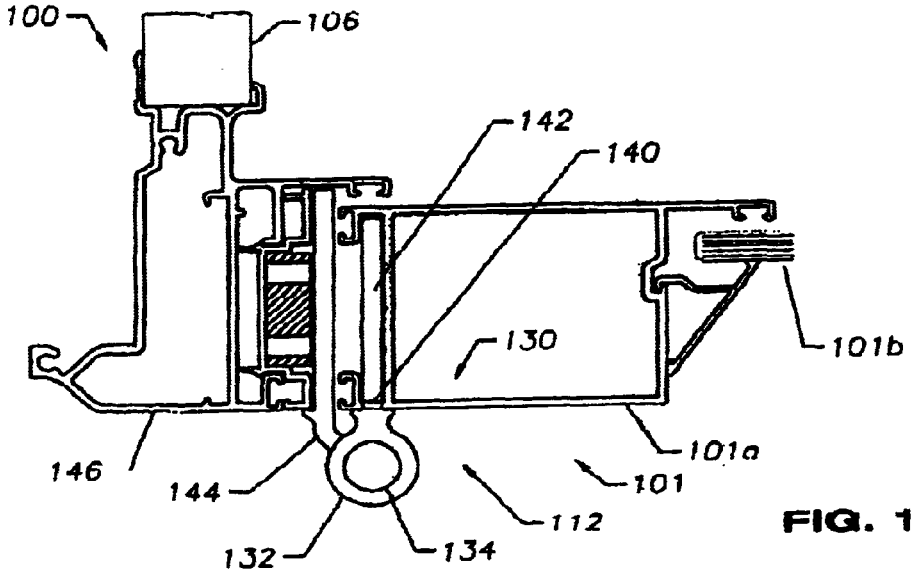

FIG. 1 illustrates a junction 100, (A) illustrating a swinging and optional movable connection 102 according to the present invention supported on a wheel 104 at an orthogonal partition section 106, with an in-situ detachable connecting link 108 clamped by a screw 110, and (B) illustrating a standard swinging hinge connection 112 at a fixed orthogonal partition section 106.

Figure 2:
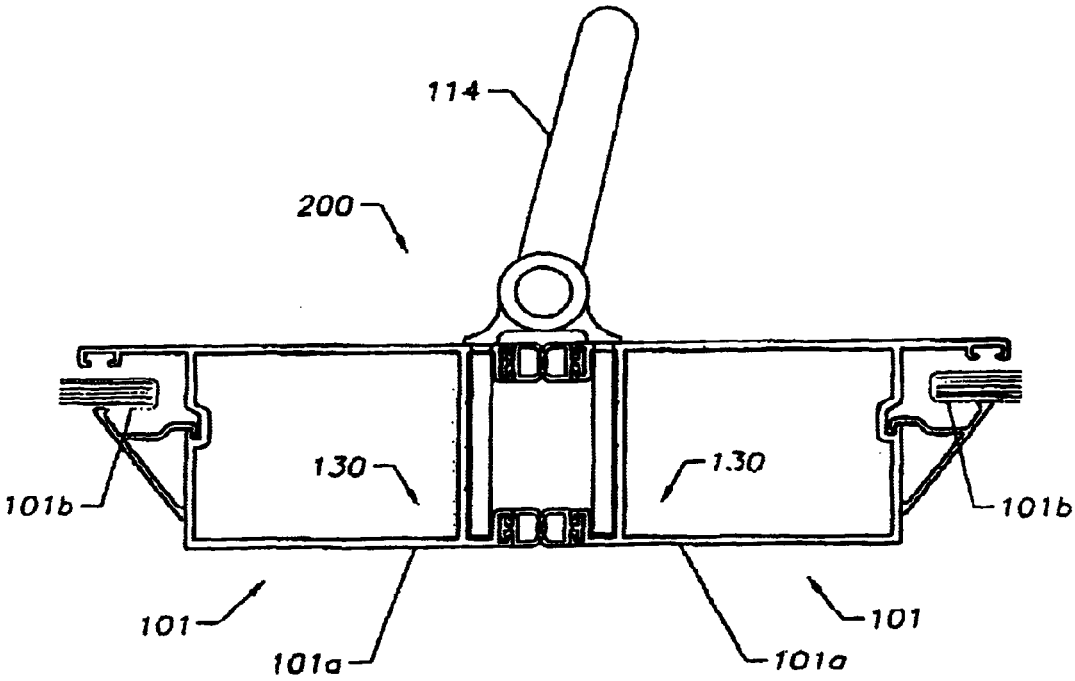

FIG. 2 illustrates a junction 200, being a simple folding connection with a pull handle 114.

Figure 3:
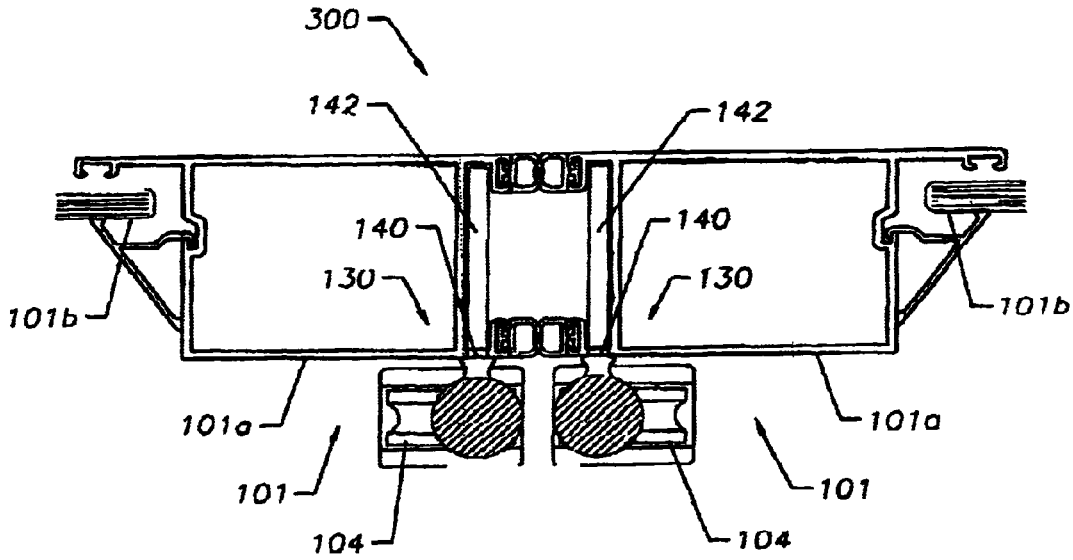

FIG. 3 illustrates a junction 300, for abutting ends of panels 101 moving on wheels 104 on a track.

Figure 4:
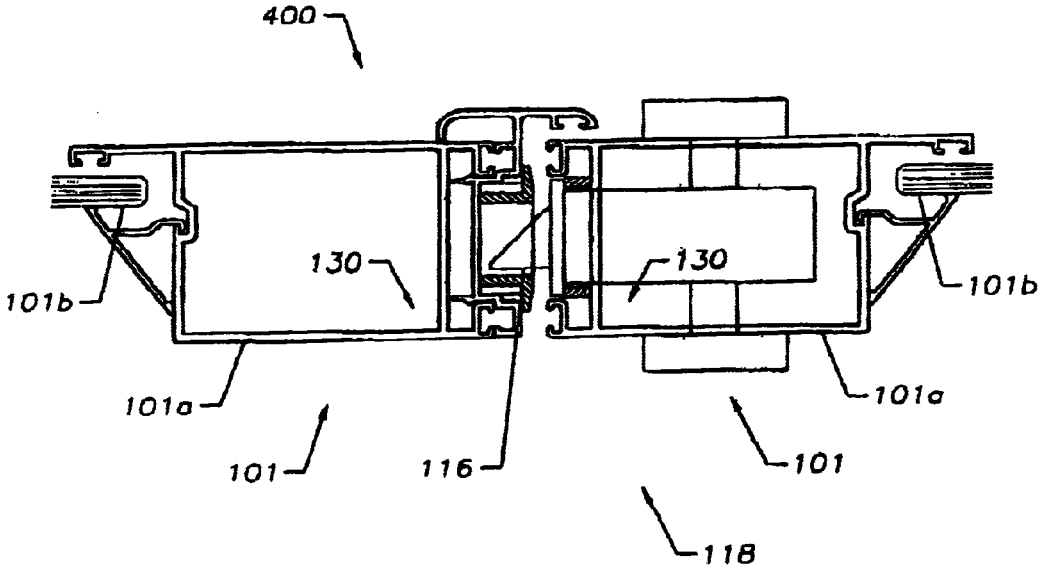

FIG. 4 illustrates a junction 400, being a connection with a door latch 116 and an opening door generally indicated by arrow 118 on the right.

Figure 5:
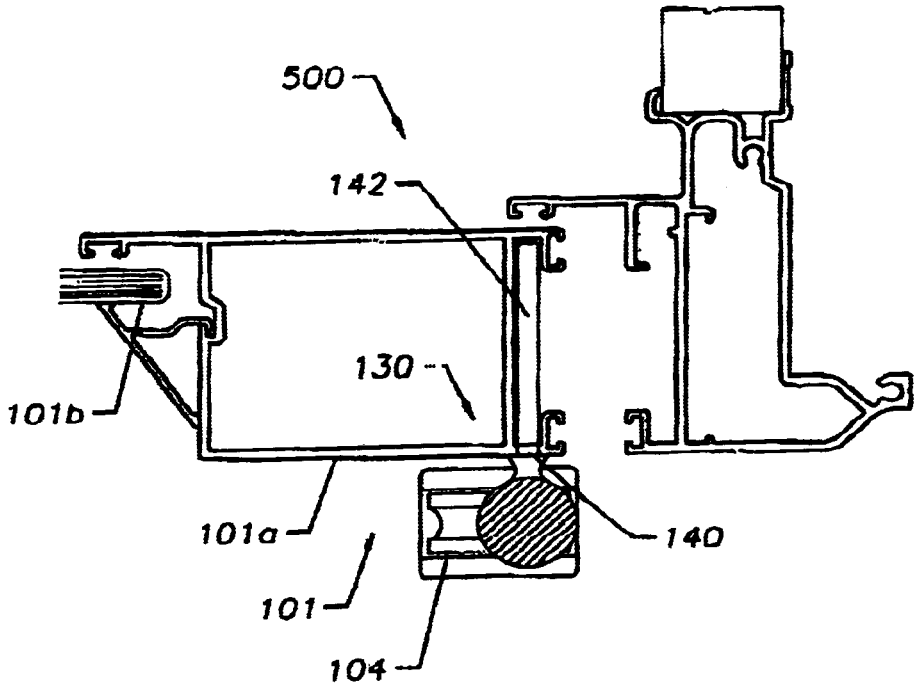

FIG. 5 illustrates a junction 500, being an end panel connection of a folding or sliding panel supported on a wheel 104 on a track.

Figure 6:
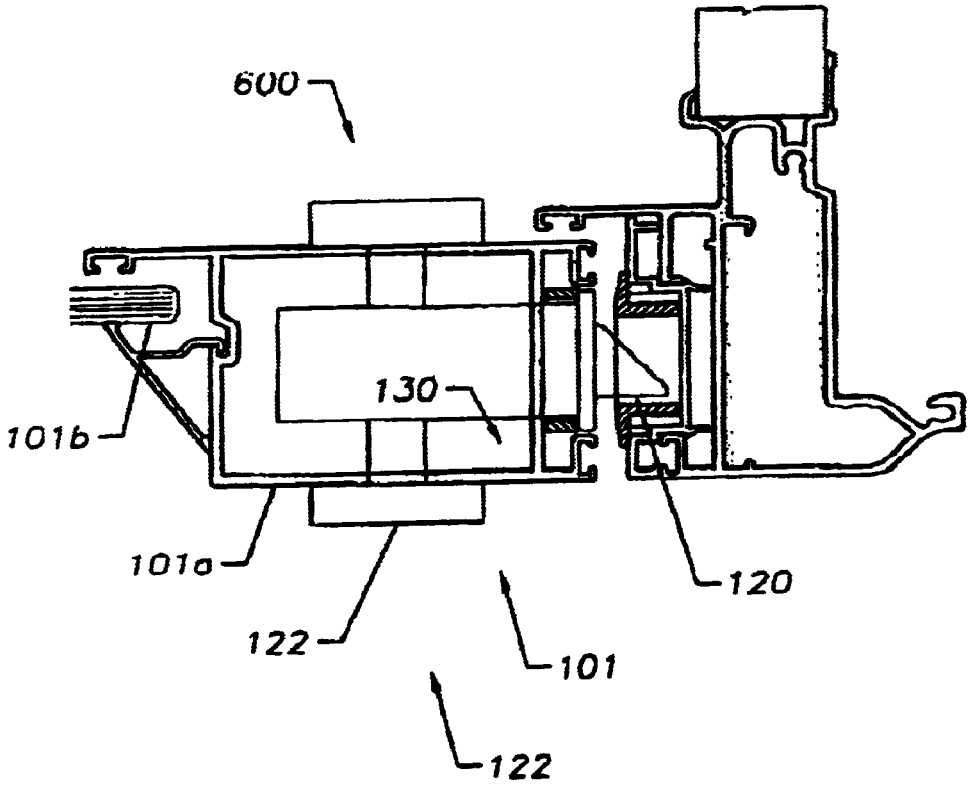

FIG. 6 illustrates a junction 600, being a connection with a door latch 120 and an opening door generally indicated by arrow 122 on the left.

Figure 7:
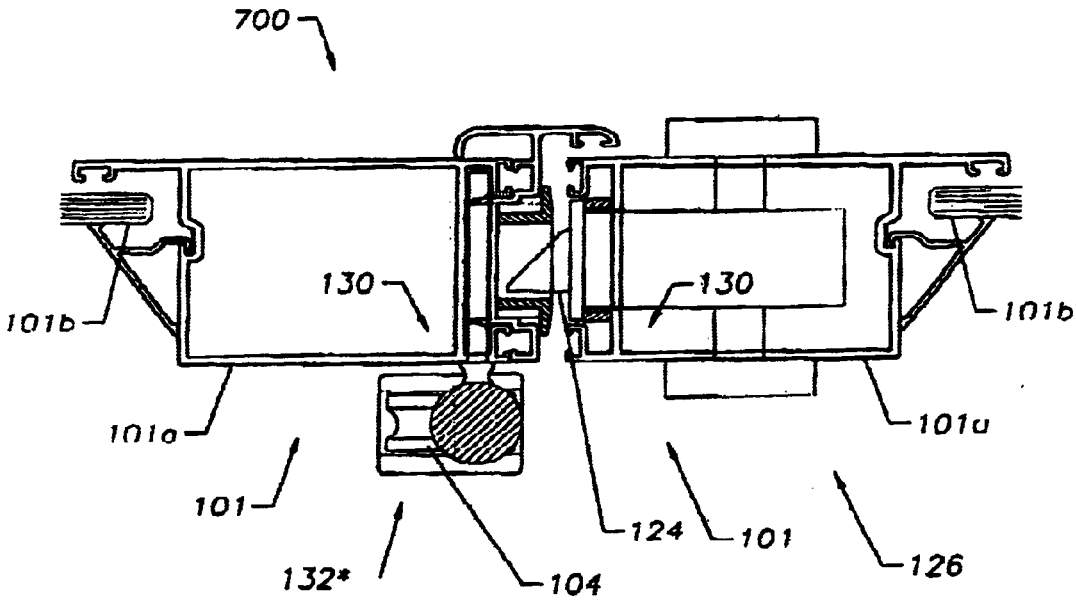

FIG. 7 illustrates a junction 700, being an end panel connection of a folding or sliding panel supported on a wheel 104 on a track, and having a door latch 124 for an opening door generally indicated by arrow 126 on the right.

Figure 8:
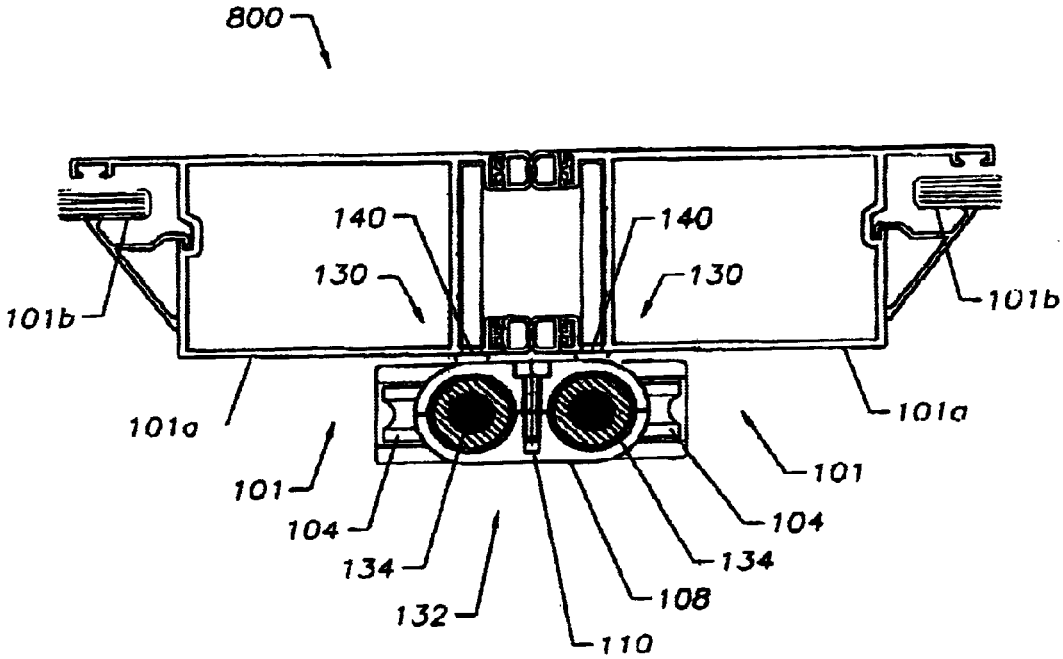

FIG. 8 illustrates a junction 800, being a bi-fold panel connection with an in-situ detachable connecting link 108 clamped by a screw 110 similar to the configuration in FIG. 1A, according to the present invention.

As shown in FIG. 1 through FIG. 8, the panel 101 comprising the extruded frame 101*a* and the glass panel 101*b*, has one edge portion 130 thereof adapted to enable optional fitting of a hinge device 132 (FIG. 1A and FIG. 8).

As will be understood from the figures, the hinge device 132 can be optionally fitted to any of the panels 101 in FIGS. 1 to 8 as required, by simply forming a slot 140 in the side face of the edge portion 130 to take a locating plate 142 of the hinge device 132. Generally the hinge device 132 will be provided at least towards the top and bottom of the panel 101, however one or more additional hinge devices 132 may be provided intermediate of these.

The configuration of the hinge device 132 will depend on the location and function thereof. For example as shown in FIG. 1A the hinge device 132 is designed for connecting to another fixed panel by the link 108, while in FIG. 8, the hinge device is used for connecting to another swingable panel by the link 108. However, as will be apparent from FIGS. 1 to 8, the same panels 101 can be used for all the different functions of the panel 101, and the hinge device 132 can be fitted as required.

By having such a panel 101 where the hinge device 132 can be optionally fitted thereto, a standard panel 101 can be used for different functions, depending on whether or not the hinge device 132 is fitted.

For example with no hinge device 132 fitted, the edge portion 130 of the panel 101 can function as a standard panel edge portion such as the latch edge of a door (FIGS. 4, 6 and 7 junctions 400, 600 and 700), the edge of two folding panels (FIG. 2 junction 200), or a fixed edge. When the hinge device 132 is fitted, the edge of the panel can function as the hinged edge of a door hinged to a fixed panel with a similar panel edge by means of the link 108 (FIG. 1A junction 100), or the adjacent hinged edges of a bi-fold panel assembly with the adjacent panels 101 linked together by the link 108 of the hinge device 132 (FIG. 8 junction 800).

The hinge device 132, while shown here in the form of a pivot shaft 134 and a locating plate 142 with substantially orthogonal axes, the locating plate 142 being of a suitable cross-section for fitting into the slot 140 in the side of the panel 101, and being secured to the panel 101, other configurations are of course possible. For example the hinge device may be simply attached to the side of the panel by means of an integral plate member.

FIG. 9 through FIG. 15 illustrate an panel system according to the present invention in the form of a bi-fold door/window panel system. In this panel system, the panels 101 as described above are adapted for a bi-fold panel system using different configurations such as shown in FIG. 1A, FIG. 3, FIG. 5, FIG. 7 and FIG. 8. A feature of this aspect of the invention is that bi-fold panel assemblies can be connected together in-situ, to enable different configurations to be optionally selected after installation.

Figure 9:
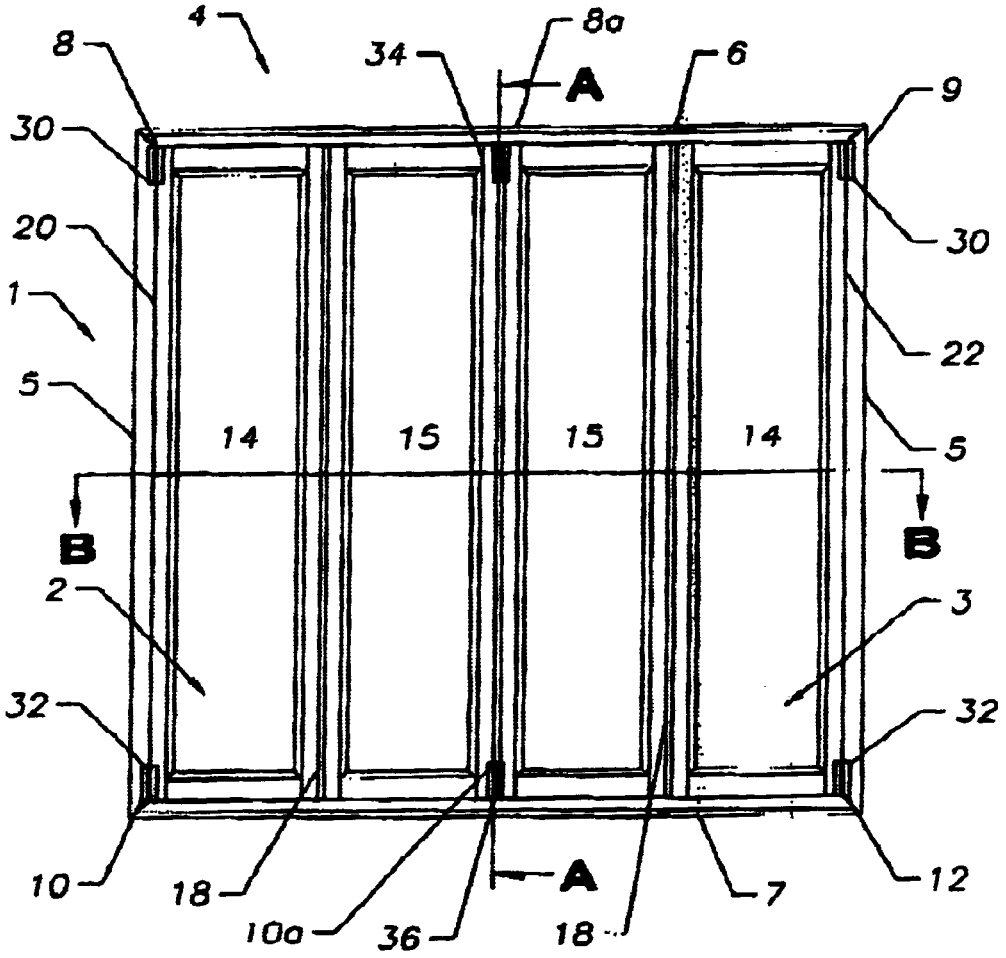
FIG. 9 is an overall schematic diagram illustrating a panel system according to the present invention in the form of a bi-fold door/window panel system.
Figure 10:
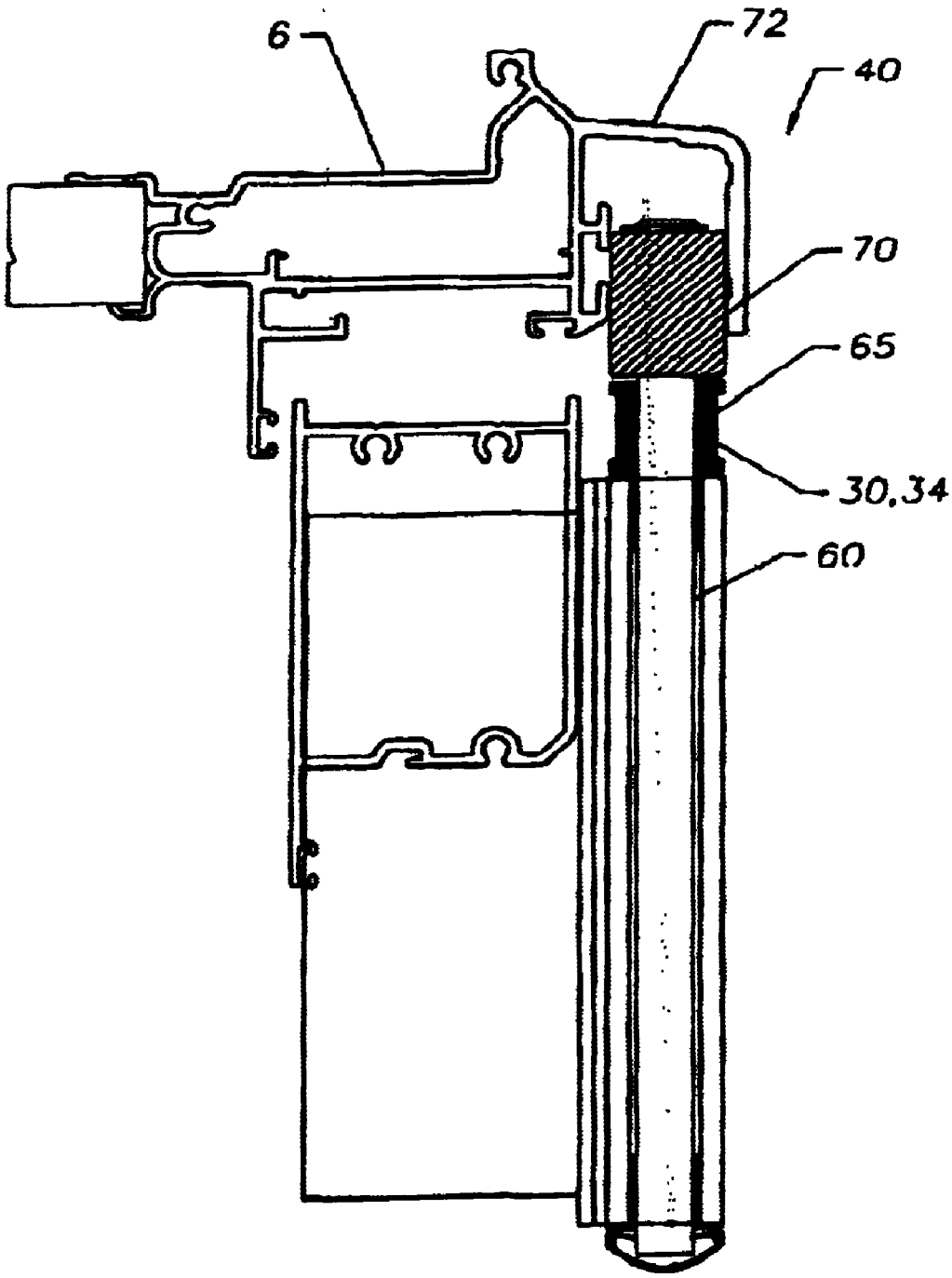
FIG. 10 is an enlarged view showing details of a cross section view on A—A of FIG. 9 of a top track and connection device.
Figure 11:
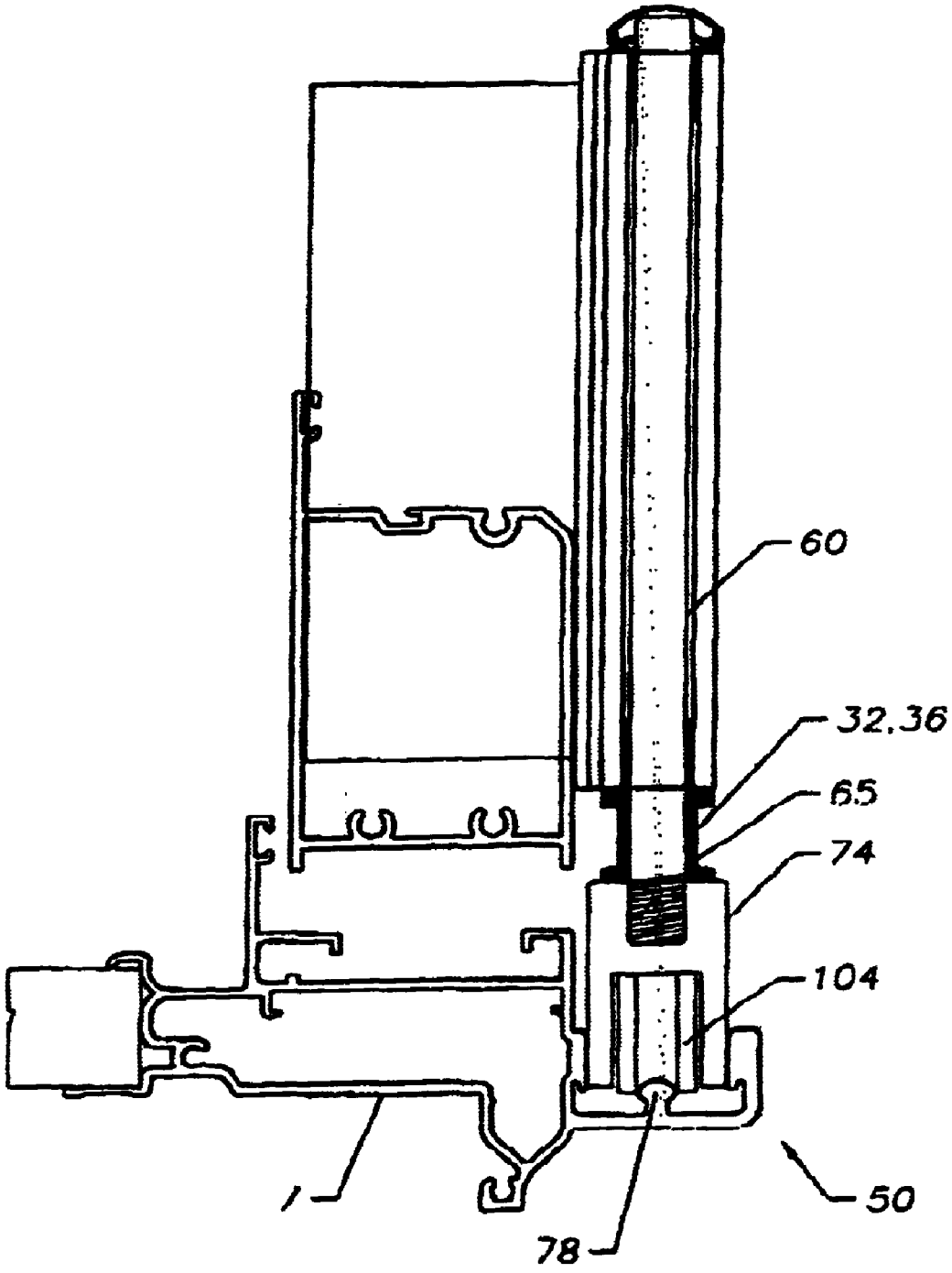
FIG. 11 is an enlarged view showing details of a cross section view on A—A of FIG. 9 of a bottom track and connection device.
Figure 12:
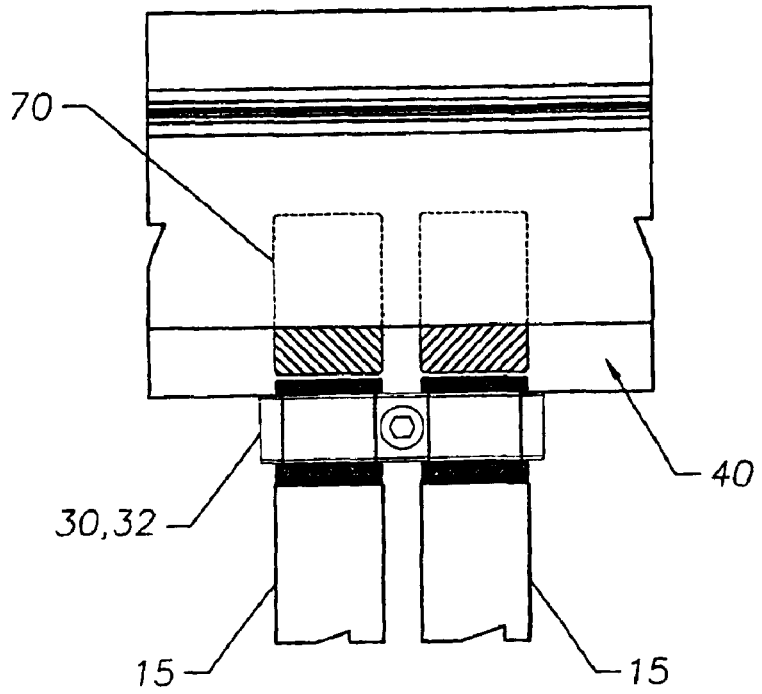
FIG. 12 is an enlarged view showing front view details of the top track and connection device with panels folded together.
Figure 13:
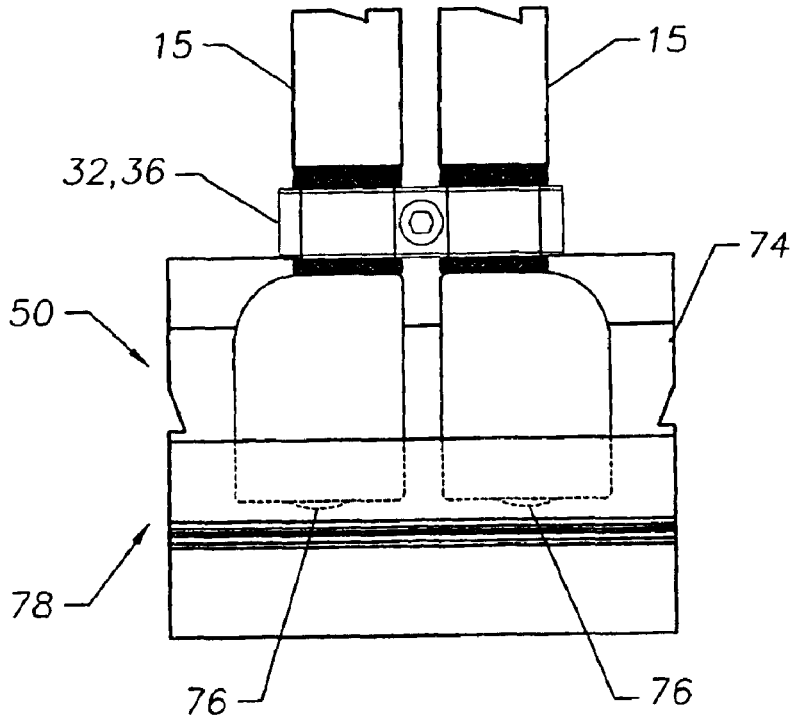
FIG. 13 is an enlarged view showing front view details of the bottom track and connection device with panels folded together.

FIG. 9 is a schematic diagram illustrating a bi-fold panel system generally indicated by arrow 1 according to the present invention, showing an overall layout of two bi-fold panel assemblies generally indicated by arrows 2 and 3 of the bi-fold panel system 1, installed in a frame for an opening of a doorway, generally indicated by arrow 4 comprising side frames (jambs) 5, a top frame 6 and a bottom frame 7. Since in this case the panel assemblies 2 and 3 are identical, similar parts are denoted by the same reference numerals. FIG. 10 and FIG. 12 show details of a top track arrangement at 8, 8*a* and 9 for opposite edges of each of the panel assemblies 2 and 3, and FIG. 11 and 13 show details of a bottom track arrangement at 10, 10*a* and 12.

As shown in FIG. 9 each of the panel assemblies 2 and 3 comprise two panels 14 and 15 hinged together along one edge 18 so as to be foldable thereabout. Moreover one edge 20 and 22 of each bi-fold panel assembly 2 and 3 is adapted for in-situ pivotal connection to the opening frame (jamb) 5 by means of hinge connection devices 30 and 32 at the top and bottom respectively, similar to the connection 100 of FIG. 1A, and the other edge 24 and 26 is adapted for in-situ pivotal connection to the adjacent bi-fold panel assembly by means of hinge connection devices 34 and 36 (see FIG. 14 for details of bottom connection) at the top and bottom respectively, similar to the connection 800 of FIG. 8.

By having a construction where adjacent edges 24 and 26 of the bi-fold panel assemblies 2 and 3 are adapted for in-situ pivotal connection to each other, and the other edges 20 and 22 are adapted for in-situ pivotal connection to the opening frame 5, the bi-fold panel assemblies 2 and 3 can be connected together by the hinge connection devices 34 and 36, or optional edges can be connected to the opening frame 5 by the hinge connection devices 30 and 32, in-situ, to enable different configurations.

In this embodiment, hinge connection devices 30 and 32 having a similar construction, are used for all the hinge connection devices 30, 32, 34 and 36 so that either edge 20, 22, 24 or 26 of the bi-fold panel assemblies 2 and 3 can be optionally connected. This enables for example simplification of design and a reduction in parts. However the invention is not limited to this. For example the hinge connection devices for connecting the bi-fold panel assemblies at the edges 24 and 26 may be different to those connected to the opening frame 5 at the edges 20 and 22. Since the edges connected to the opening frame 5 do not need to be sliding supports, then a simple hinge may be provided, or a hinge device such as with connection 100 of FIG. 1B may be provided. In the case of a configuration to allow folding to either side from the center, or to one specific side, the connection to the opening frame 5 at that side need not be an in-situ releasable connection, and need not have a location device such as a track guide device (to be described hereunder).

Moreover in some situations it may not be necessary to provide a track guide device at the edge, but to merely have a device to secure the bi-fold panel assembly once in the opened or closed condition. Furthermore, the guide device may simply involve a rail arranged at the opening base or top area so as to engage with one side of the bi-fold panel assembly to prevent side swing.

In the configuration shown in FIG. 9, the two panel assemblies 2 and 3 may be connected together at their adjacent edges 24 and 26 and either of the edges 20 or 22 adjacent to the opening frame 5 may be connected thereto by the hinge connection devices 30 and 32, while the other edge 20 or 22 is left free, so that the bi-fold panel system 1 can enable folding completely to the left or right side of the opening. Alternatively the two edges 20 and 22 adjacent to the opening frame 5 may be connected thereto and the adjacent edges 24 and 26 left free to enable opening of one bi-fold panel assembly 2 to one side and the other bi-fold panel assembly 3 to the other side.

Figure 15:
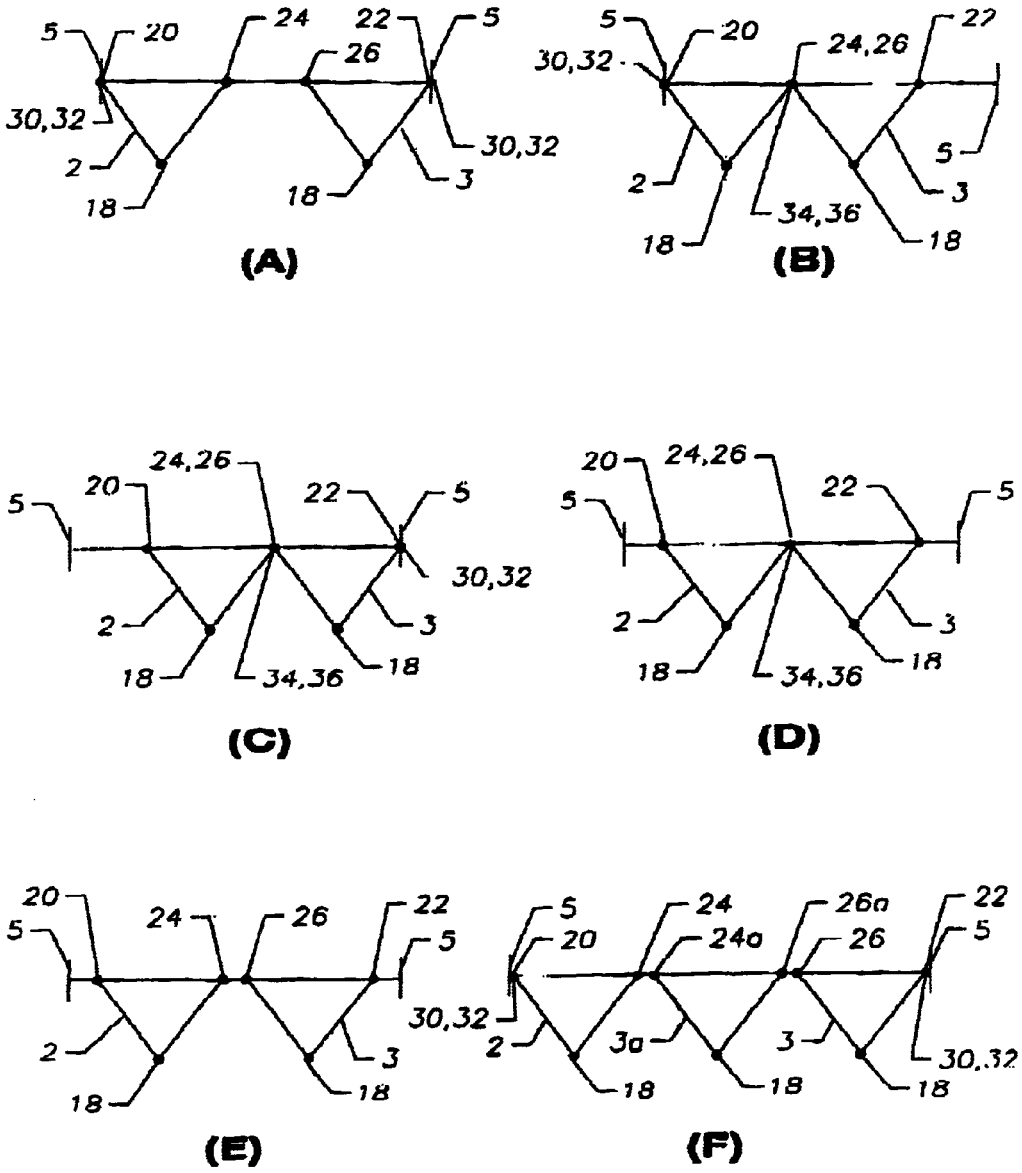
FIG. 15 shows typical configurations possible with the bi-fold panel system of the present invention.

Typical configurations which are possible with the bi-fold panel system of the present invention are shown in FIG. 15. In FIG. 15(A), the left and right edges 20 and 22 of the bi-fold panel assemblies 2 and 3 adjacent to the opening frames 5 are connected to the frames 5 by the hinge connection devices 30 and 32, and their opposite edges 24 and 26 are left free. In FIG. 15(B), the left edge 20 adjacent to the opening frame 5 is connected to the frame 5 by the hinge connection devices 30 and 32, the adjacent edges 24 and 26 are connected together by the hinge connection devices 34 and 36, and the right edge 22 is left free. In FIG. 15(C), the right edge 22 adjacent to the opening frame 5 is connected to the frame 5 by the hinge connection devices 30 and 32, the adjacent edges 24 and 26 are connected together by the hinge connection devices 34 and 36, and the left edge 20 is left free. In FIG. 15(D), the left edge 20 and the right edge 22 are left free and the adjacent edges 24 and 26 are connected together by the hinge connection devices 34 and 36, so that the panel assemblies 2 and 3 can be moved together to an optional location in the opening. In FIG. 15(E), the left edge 20 and the opposite edge 24 of the panel assembly 2, and the right edge 22 and the opposite edge 26 of the panel assembly 3 are left free, so that the panel assemblies 2 and 3 can be moved separately to optional locations in the opening. In FIG. 15(F), an additional bi-fold panel assembly 3*a* is provided intermediate of the panel assemblies 2 and 3, as may be the case for wider openings, giving a triple bi-fold panel system. In this optional configuration with this triple bi-fold panel system, the left and right edges 20 and 22 of the bi-fold panel assemblies 2 and 3 adjacent to the opening frames 5 are connected to the frames 5 by the hinge connection devices 30 and 32, and their opposite edges 24 and 26 are left free. Moreover, the left and right edges 24*a* and 26*a* of the intermediate bi-fold panel assembly 3*a* are left free. It will be obvious that many other combinations are also possible with any number of intermediate panel assemblies, which may or may not be bi-fold, depending on requirements.

By having the above described construction, the method of the present invention of enabling in-situ optional configurations of bi-fold panel assemblies of a bi-fold panel system, can be easily realised.

As also shown in FIG. 10 to FIG. 14, each of the panel assemblies 2 and 3 further comprise location devices in the form of a slide device (at the top) generally indicated by arrow 40 (FIGS. 10 and 12) and a slide and roller device (at the bottom) generally indicated by arrow 50 (FIGS. 11, 13, 14) for slidably locating both opposite edges 24 and 26, and 20 and 22 of the bi-fold panel assemblies 2 and 3.

By providing the slide devices 40 or slide and roller devices 50 for slidably locating both opposite edges 24 and 26 and 20 and 22 of the bi-fold panel assemblies 2 and 3 (rather than only one edge as with conventional bi-fold panel assemblies), the panel assemblies 2 and 3 can be optionally connected to each other by the hinge connection devices 34 and 36, or to either edge of the opening frame 5 by the hinge connection devices 30 and 32, with the unconnected edge slidably located to ensure location of the edge when opening and closing.

Figure 14:
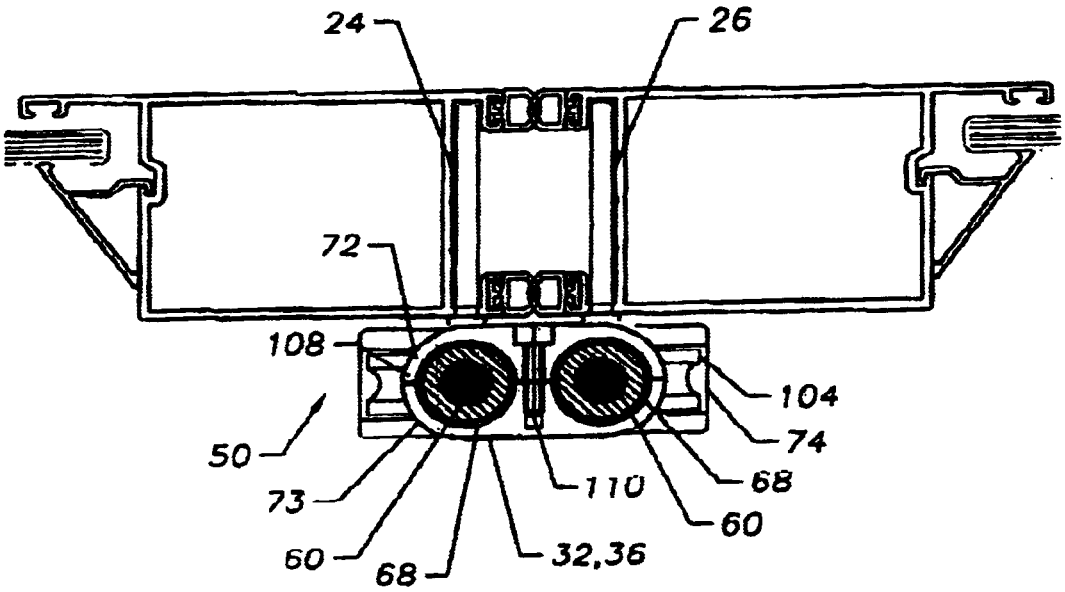
FIG. 14 is an enlarged view showing details of a plan view on B—B of FIG. 9 of the connection device with the edges of the panels abutted together.

As shown in FIGS. 10, 11, and 14, with this embodiment the connection device (hinge device) comprises a linkage involving a cylindrical vertical rod 60 about which the connecting link 108 can pivot and connect between the cylindrical vertical rods 60 of the adjacent panels, or a vertical rod provided on the opening frame 5. The connecting link 108 is thus provided with two apertures 68 (FIG. 14) spaced apart for accommodating the cylindrical vertical rods 60.

As shown in FIG. 14, the connecting link 108 is formed from two members 72 and 73 so as to enable the connecting link 108 to be fitted in-situ to the vertical rods 60. These members 72 and 73 are clamped together once fitted, by the screw 110. A similar configuration is shown in FIGS. 1 and 8. Of course there are many other possible configurations for the connecting link 108, whereby this can be fitted to perform the required function of connecting between the adjacent vertical rods 60. Moreover, configurations are also possible using for example a connecting link having pins which are inserted in sockets in the panels.

Furthermore as shown in the FIGS. 10 and 11, the vertical rods 60 also serve as a member for the location devices 40 and 50. That is the vertical rods 60 at the opposite top edges of the panel assemblies are fitted with a slide pad or wheel 70 for sliding in a top track 72 (FIGS. 10 and 12), and the vertical rods 60 at the opposite bottom edges of the bi-fold panel assemblies are fitted with a slide pad 74 and a horizontal axis wheel 104 for sliding and rolling in a bottom track 78 (FIGS. 11, 13 and 14).

In this embodiment the connecting links 108 are provided in two parts to enable fitting to the rod 60 from the outside of the bi-fold panel assembly. However, the invention is not limited to this, and other configurations are possible. For example the configuration of the vertical rods may be such that the connecting links 108 can be fitted over ends of the vertical rods. In this case the connecting links may be formed as single units with two apertures spaced apart for accommodating the cylindrical rods of the adjacent panel assemblies.

Moreover in the case where the rod 60 is used for the hinge connection devices 30, 32, 34 or 36, the bi-fold panel assembly may need to be partially removed or folded to a certain angle in order to fit or remove the connecting links 108 from the end of the rod 60 or from the side of the rod 60. This is particularly the case where the rod 60 is aligned with a central region of the panel assembly such as in-situations where it is desired to minimize twisting forces on the panel support track, which arise with heavy panels when the rod 60 is arranged to one side of the panel, as with the present embodiment.

It is also to be understood that it is not necessary for the rod of the hinge connection device to also serve as a member of the location device as with the present embodiment, and other configurations are also possible.

I believe the advantages of my invention to be as follows, however it should be appreciated that all such advantages may not be realised on all embodiments of the invention and the following list is given by way of example only as being indicative of potential advantages of the present invention. Furthermore it is not intended that the advantages of the present invention be restricted to those of the list which follows:

1. The panel assembly of the invention where a hinge device can be optionally fitted thereto in the above manner enables the same standard design panel to be used for different functions, depending on whether or not a hinge device is fitted, and the type of hinge device.
2. The bi-fold panel system of the invention, having two or more bi-fold panel assemblies which can be optionally connected in-situ to each other to give different folding configurations, enables different bi-fold panel configurations to be optionally selected after installation. Hence versatility of the bi-fold panel system is improved, enabling a reduction in the number of different parts required, and stock holding, and moreover enabling the configuration to be changed in-situ to suit different requirements.
3. By providing a hinge connection device which uses vertical pins of the location device of the bi-fold panel assembly, the number of components can be kept to a minimum and the design simplified.

Aspects of the present invention have been described by way of example only and it should be appreciated that modifications and additions may be made thereto without departing from the scope of the invention as defined by the appended claims.

I claim:

1. A panel system comprising; a plurality of panels, and hinge means for supporting one edge of at least one of said panels to allow pivotal movement thereabout, wherein said plurality of panels comprises a bi-fold panel assembly of two panels hinged together along one edge of each so as to be foldable thereabout, and said hinge means comprises two parallel pivot supports spaced apart in a plane orthogonal to pivot axes thereof, and a connecting link for connecting between and coupling the two parallel pivot supports together, the connecting link comprising two members that are attachable so as to define two apertures for receiving the two parallel pivot supports thereinside and detachable so as to uncouple the two parallel pivot supports.

2. A panel system according to claim 1, wherein the connecting link of at least one of said hinge means is adapted so as to be connectable in-situ to said pivot supports.

3. A panel system according to claim 2, wherein at least one edge of said bi-fold panel assembly is adapted for in-situ pivotal connection to another panel assembly such as a bi-fold panel assembly.

4. A panel system according to claim 3, wherein at least one edge of said bi-fold panel assembly is adapted for pivotal in-situ connection to an opening frame.

5. A panel stem according to claim 4, comprising location means for locating at least on edge of said bi-fold panel assembly, so an to be linearly slidable when opening and closing.

6. A panel system according to claim 5, wherein said location means comprises a guide member secured to said bi-fold panel assembly, which slides in a groove on the top or bottom of an opening in which said bi-fold panel assembly is installed.

7. A panel system according to claim 6, wherein a pivot support of said connection means also serves as a member for said location means.

8. A panel system according to claim 1, wherein said connecting link comprises a clamping means for clamping said two members together.

9. A hinge device for connecting to a panel of a panel system said hinge device comprising two parallel pivot supports with at least one of said pivot supports fitted with mounting means for mounting attachment to an edge of a panel of said panel system, and a connecting link for connecting between and coupling the two parallel pivot supports together so as to hold said pivot supports spaced apart in a plane orthogonal to pivot axes thereof, the connecting link being attachable so as to define two apertures for receiving the two parallel pivot supports thereinside and detachable so as to uncouple the two parallel pivot supports, said connecting link comprises two members and clamping means for clamping said two members together.

10. A method of enabling optional in-situ configuration within an opening, of a panel system comprising at least one bi-fold panel assembly of two panels hinged together along one edge of each so as to be foldable thereabout, said method comprising the steps of:

providing hinge means for supporting one edge of said bi-fold panel assembly to allow pivotal movement thereabout, said hinge means comprising two parallel pivot supports spaced apart in a plane orthogonal to pivot axes thereof, and a connecting link for in-situ connection between and coupling the two parallel pivot supports together, the connecting link comprising two members that are attachable so as to define two apertures for receiving the two parallel pivot supports thereinside and detachable so as to uncouple the two parallel pivot supports connecting one of said pivot supports to a side member of said opening, or to the edge of another panel in said opening, and connecting the other of said pivot supports to said edge of said bi-fold panel assembly; and optionally connecting said pivotal supports with said connecting link to obtain an optional configuration of said panel system.

* * * * *